United States Patent [19]

Takatsuka et al.

[11] 4,408,108

[45] Oct. 4, 1983

[54] PUFFER TYPE GAS INTERRUPTER

[75] Inventors: Keizo Takatsuka; Hiroshi Yamamoto; Toshihiro Baba, all of Amagasaki, Japan

[73] Assignee: Mutsubishi Denki Kabushiki Kaisha, Tokyo, Japan

[21] Appl. No.: 256,603

[22] Filed: Apr. 22, 1981

[30] Foreign Application Priority Data

Apr. 25, 1980 [JP] Japan ..... 55-56629

[51] Int. Cl.[3] ..... H01H 33/74

[52] U.S. Cl. ..... 200/148 A; 200/150 G

[58] Field of Search ..... 200/148 A, 150 G

[56] References Cited

U.S. PATENT DOCUMENTS 3,257,532 6/1966 Lerch ..... 200/148 A 4,139,751 2/1979 Roston et al. ..... 200/148 A

*Primary Examiner*—A. T. Grimley

*Assistant Examiner*—Morris Ginsburg

*Attorney, Agent, or Firm*—Robert E. Burns; Emmanuel J. Lobato; Bruce L. Adams

[57] ABSTRACT

A puffer type gas interrupter has an extra movable conducting cylinder mounted concentrically around and in fixed electrical contact with the puffer cylinder which functions to blow out the arcs produced at the moment of interruption. This conducting cylinder forms an electrical connection between stationary side finger contacts and movable side finger contacts at times of normal operation when the interrupter is in the closed state, and since, unlike the puffer cylinder, its dimensions are not constricted by the need to consider the arc blowing performance, its thickness and diameter may easily be appropriately selected to provide a current carrying area suitable for the carrying of a large main circuit current.

7 Claims, 3 Drawing Figures

PUFFER TYPE GAS INTERRUPTER

BACKGROUND OF THE INVENTION

1. Field of the Invention

This invention relates to puffer type gas interrupters, and in particular concerns itself with puffer type gas interrupters which are suitable for handling large currents.

2. Description of the Prior Art

When an interrupter is required to carry a large current, at times of interruption when the contacts of the interrupter separate, the large current being passed causes an arc to form across the opened contacts. This arc, unless extinguished, can damage the contacts, causing pitting, and ultimately greatly shortening the life of the contacts. Thus to combat the problem of arcing, the puffer type gas interrupter was developed, wherein a gas puffer mechanism comprising, typically, a movable puffer cylinder running over a sliding puffer piston. The movable puffer cylinder contains an insulating gas which is compressed by the puffer mechanism which is operated at the time of interruption, and the gas is forcefully ejected through an aperture at the front of the puffer cylinder to blow out any arc that is formed.

Typically the puffer type gas interrupters of the prior art were constructed with the interrupter comprising an insulating housing filled with an arc extinguishing gas and containing a central tubular arc contact set consisting of a movable arc contact and a stationary arc contact over which the movable arc contact slides in electrical contact when the interrupter is closed. Around the movable arc contact and in sealing sliding contact therewith is a fixed, stationary puffer piston over which sealingly slides a puffer cylinder which is rigidly mechanically fixed to the movable arc contact to move therewith, and into one end of which the puffer piston slides and the other end of which is closed except for an aperture surrounding the central tubular movable arc contact at a certain distance to allow the insulating gas contained therein to be forced out when an interruption causes the movable arc contact to be drawn, pulling the puffer cylinder with it over the puffer piston. The gas thus forced out is guided by a funnel-like flow guide of an insulating material fixed to the front of the puffer cylinder, thus forming a gas flow to blow out any arc that forms. The current carrying capacity of the device is beyond that enabled by the arc contact set alone by using the body of the puffer cylinder to form a circuit between contacts, such as a cluster of finger-like contacts of a segmented slotted-finger construction, disposed on the movable arc contact side and the stationary arc contact side. The segmented slotted-finger contacts make sliding contact with the puffer cylinder permanently on the movable arc contact side, and at times of normal operation when the interrupter is closed, on the stationary arc contact side.

In recent year, however, the main circuit currents which interrupters have been required to handle have becoming increasingly large. The puffer type gas interrupters of the prior construction just discussed, in order to increase the current carrying capability, it is necessary to increase the current carrying cross-sectional area by enlarging the thickness or the diameter of the puffer cylinder. However, in increasing the thickness of the puffer cylinder, its effective conducting area (related to the depth of the surface skin) which is determined by the material employed, ceases to show improved effect beyond a certain increase in thickness. And in increasing the diameter, an adverse effect on the pressure rise characteristics of the compressed gas blown at the arc during interruption may occur, and the gas flow may alter, affecting interruption performance, and so necessitating a modification in the operation mechanism, which is the drive source.

Accordingly, in the prior art, when it was necessary to alter the current carrying capacity of the interrupter, it was also necessary to change the design of other structural elements such as the puffer piston, etc. Therefore it was extremely difficult to alter the current carrying capacity of existing interrupters, and in many instances, it was necessary to replace the entire interrupter. Also, it was difficult to meet future changes in current carrying capacity demands. Further, it was difficult for the manufacturer to produce a series of interrupters consisting of interrupters of various current carrying capacities.

SUMMARY OF THE INVENTION

Accordingly it is an object of this invention to provide a structure for a puffer type gas interrupter that eliminates the drawbacks of the prior art and enables large currents to be passed without affecting the other characteristics of the interrupter such as arc blowing performance, and without modifications to the drive mechanism.

This object is achieved by providing an additional conducting cylinder disposed concentrically around the puffer cylinder which acts as the movable conductor which completes a current path between the stationary arc contact side and the movable arc contact side finger contacts when the interrupter is in the closed state. By providing the additional movable conducting cylinder around the puffer cylinder it is possible to increase the current conducting area by increasing the thickness and/or the diameter of the additional cylinder as necessary to obtain the required current conducting area for the desired main circuit current without altering the dimensions of the puffer cylinder, and therefore without affecting the arc blowing performance.

DESCRIPTION OF THE PREFERRED EMBODIMENTS

Figure 1:
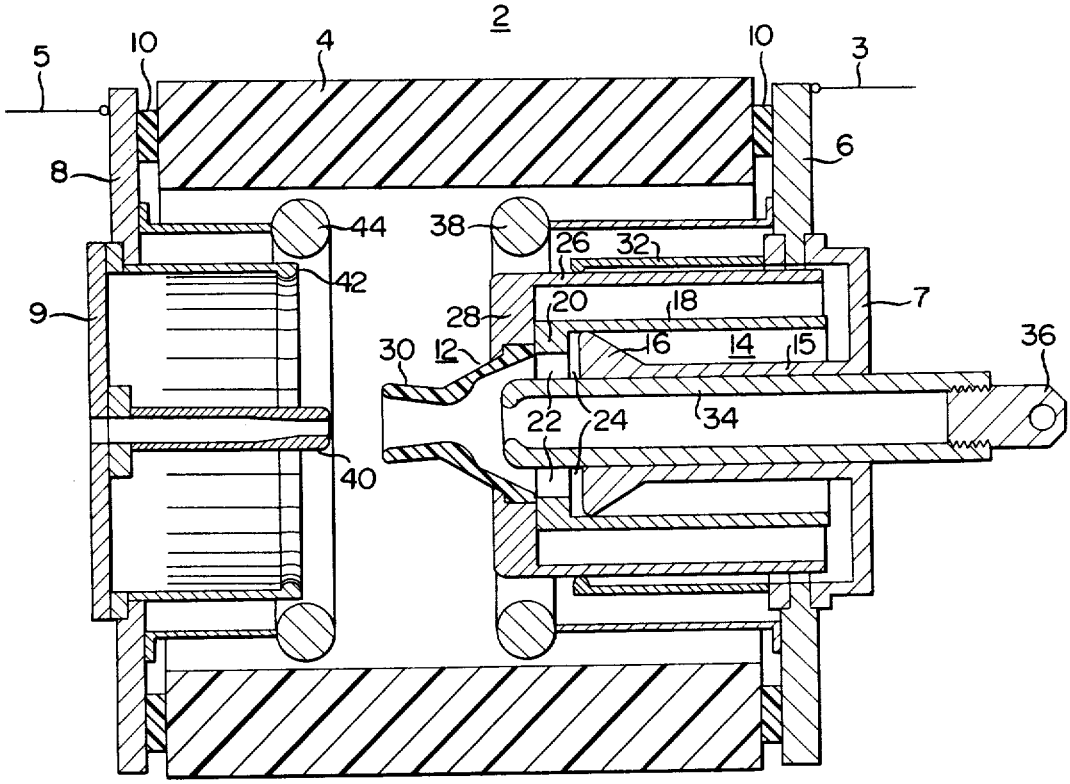
FIG. 1 is a longitudinal cross-sectional view of the puffer type gas interrupter according to the present invention in the open state.
Figure 2:
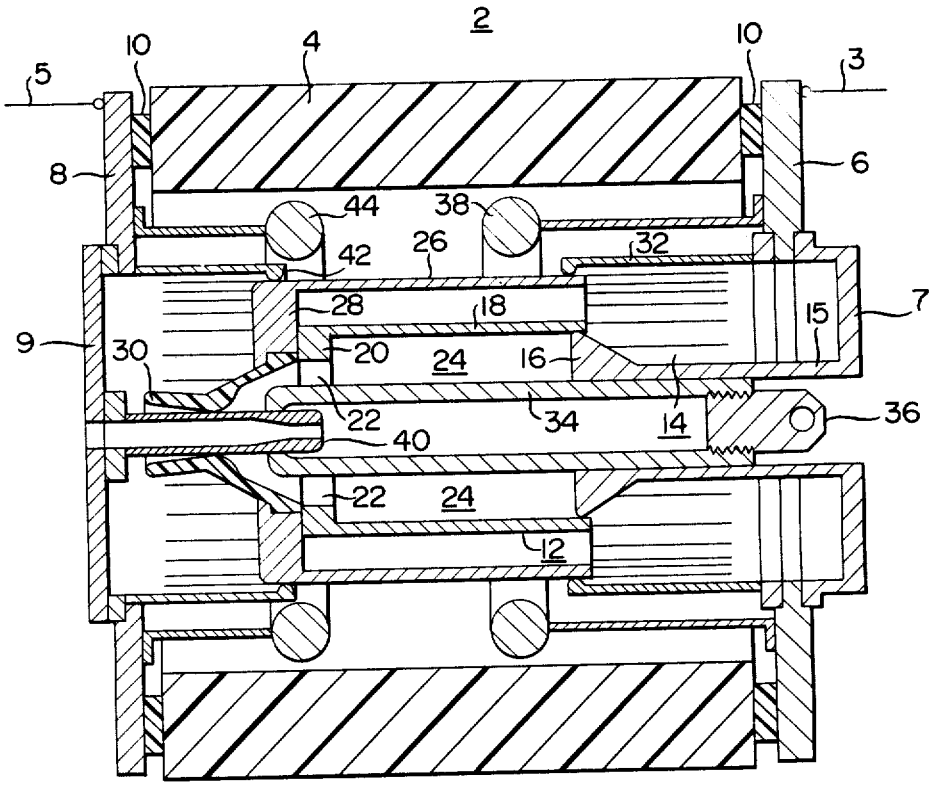
FIG. 2 is a longitudinal cross-sectional view of the puffer type gas interrupter in the closed state.

Referring now to FIGS. 1 and 2, an insulating housing 2 comprising metal end plates 6 and 8, to which respective conductors 3 and 5 are attached for connection to a circuit to be protected, fixed via insulating members 10 to an insulating tubular sleeve 4 is filled with an arc extinguishing gas and houses a puffer mechanism 12. The puffer mechanism 12 is comprised of a stationary hollow puffer piston 14 rigidly fixed to or integral with an annular central plate 7 which partially closes an aperture in the end plate 6 of the insulating housing 2, the puffer piston 14 having at least a portion thereof circumferentially extruded to form an extruded portion 16 over which rides, in sliding contact, a movable puffer cylinder 18 with one end 20 closed apart from an aperture 22 disposed centrally thereof, with a compression space 24 defined between the partially closed end 20 and the cylindrical body of the movable puffer cylinder 18 and the extruded portion 16 of the stationary piston 14. Disposed concentrically around the movable puffer cylinder 18 and in fixed electrical contact therewith via a radially inwardly extending end portion 28 which also serves as a retainer to engage and retain by clamped or threaded engagement a flow guide nozzle 30 of an insulating material fitted to the end of the puffer cylinder 18, is a movable conducting cylinder 26. The movable conducting cylinder 26 is permanently engaged in sliding contact with a movable contact side main current carrying contact 32 typically composed of a circular cluster of finger-like contacts in a segmented slotted-finger construction, disposed circumferentially around the movable conducting cylinder 26, and in fixed rigid electrical contact wwith the movable contact side end plate 6 of the insulating housing 2. Centrally disposed within the puffer cylinder 18 and passing centrally through the stationary piston 14 is a cylindrical movable arc contact 34 with the outer surface of the cylindrical movable arc contact in sealing sliding contact throughout a complete circumference of at least a portion of the inner surface of the hollow stationary puffer piston 14. The cylindrical movable arc contact 34 is in fixed electrical contact with the puffer cylinder 18 via spars or rods (not shown) which traverse the space between the inner surface of the puffer cylinder 18 and the outer surface of the movable arc contact 34, across the annular compression space or aperture 22 at the front (left side, in the figures) of the puffer cylinder, or through suitable elongated slots or gaps in the shaft portion 15 of the stationary puffer piston 14, namely that portion behind (to the right, in the figures) the extruded portion 16 of the piston 14 which is in sealing sliding contact with the inner surface of the puffer cylinder 18, and at least a portion of the inner surface of the stationary puffer piston 14 which is in sealing sliding contact with the movable arc contact 34. The movable arc contact also provides the mechanical link between the arcing contacts and puffer mechanism and the trip and drive mechanism (not shown) by means of a lug 36 at its rearmost (right-hand, in the figures) end, suitably engaged therewith by such as threaded engagement. Disposed around the entire movable conducting cylinder and puffer apparatus is a fixed circular shield 38.

To the left of the figure, fixed to a central plate 9 which partially closes an aperture in the stationary side end plate 8 of the insulating housing 2, is a hollow stationary arc contact 40 with which the movable arc contact 34 makes contact by sliding over it when the puffer type gas interrupter is in the closed state, as shown in FIG. 2. Disposed around and spaced apart from the stationary arc contact 40 and fixedly secured to the stationary contact side end plate 8 of the insulating housing 2, is a stationary main contact 42 typically composed of a circular cluster of finger-like contacts in a segmented slotted-finger construction. The stationary contact 42 come into contact with the movable conducting cylinder 26 when the puffer type gas interrupter is in the closed state, as shown in FIG. 2. Disposed around the outside of the stationary main contact 42 is fixed circular shield 44 similar to the shield 38 disposed around the movable contact side contacts 32.

Next the operation of the puffer type gas interrupter of the above described structure according to this invention is explained. In normal operation the arcing contact portion of the puffer type gas interrupter will be in the closed state, i.e. the state shown in FIG. 2, with an electrical circuit completed between the stationary contact side and the movable contact side by the contact between the movable arc contact 34 and the stationary arc contact 40, and the contact between the movable conducting cylinder 26, which is in permanent sliding contact with the movable-side finger contact 32, and the stationary side finger contacts 42, as well as the additional current carrying paths formed by the fixed electrical contact between the conducting puffer cylinder 18 and the movable conducting cylinder 26 and the former's sliding electrical contact with the conducting fixed puffer piston 14 which is in fixed electrical contact with the movable side end plate. Then, when interruption is to be effected due to the trip mechanism (not shown) being tripped, either manually or as the result of a fault, a drive mechanism (not shown) is activated to withdraw (to the right in the figures) the conducting cylinder 26 and the movable contact 34 from contact with the stationary side finger contacts 42 and the stationary arc contact 40, respectively, to interrupt the current flow. The drive mechanism connected to the interrupting mechanism via the lug 36 pulls the movable conducting elements 26 and 34 and the puffer cylinder 18, which are all rigidly fixed together, towards the right such that first the contact between the conducting cylinder 26 and the stationary side finger contacts 42 is broken, and then, shortly afterwards, the final contact between the movable and stationary sides via the movable arc contact 34 and the stationary arc contact 40 is broken, which generally results in the production of an arc across the gap formed between the movable and the stationary arc contacts 34 and 40, due to the high current flowing through the arc contacts. The arc is then blown out by a compressed gas flow formed as the gas compression space 24 is reduced in size by the puffer cylinder 18 closing in towards the extruded portion 16 of the puffer piston 14, thereby compressing the gas contained therein and forcing it out under pressure through the aperture 22 to be guided by the flow guide nozzle to blow out any arc that may develop between the arc contacts 34 and 40.

According to this structure it is possible to provide a movable conducting cylinder 26 of any desired dimensions, including its thickness and diameter, in order to provide the required current conducting area for even very large currents, without in any way affecting the arc blowing performance of the puffer mechanism 12 which may retain the same structure and size, whatever the dimensions of the conducting cylinder 26 surrounding it. In the illustrated embodiment spacing is provided between the outer surface of the cylindrical portion of the puffer cylinder 18 and the inner surface of the cylindrical portion of the movable conducting cylinder 26. This spacing is not essential per se to this invention, and the full effect of the invention could be achieved without any spacing, but an object of this invention was to provide increased current passing capability without affecting other performance characteristics, and if the spacing were not left this would mean that a conducting cylinder 26 of very large diameter would also be very thick, which, as has been said hereinbefore, offers no improved performance beyond a certain degree of thickness, and which adds to the mass and hence inertia of the moving parts that have to be withdrawn at the time of an interruption. Thus to keep inertia low the outer conducting cylinder 26 should be not thicker than necessary, and thus, of consequence, a space will be formed between the conducting cylinder 26 and the puffer cylinder 18.

Figure 3:
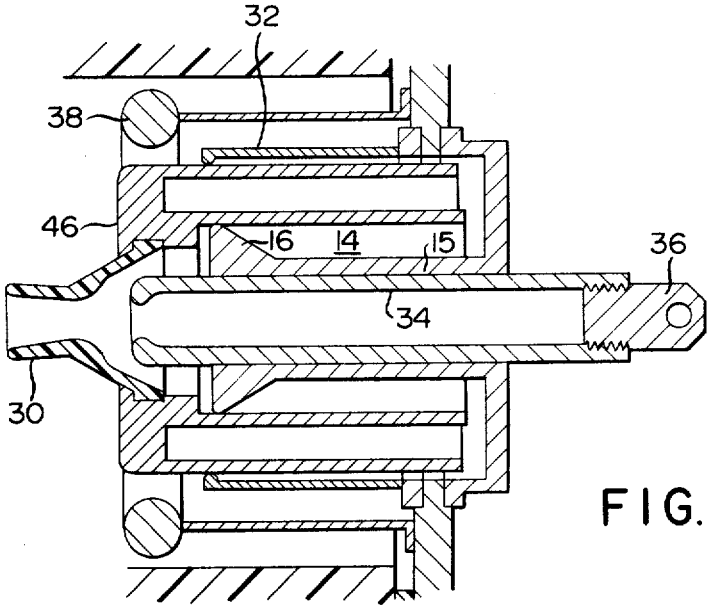
FIG. 3 is a longitudinal cross-sectional view of a portion of another embodiment of the puffer type gas interrupter according to the present invention.

This invention also contemplates forming the outer conducting cylinder 26 and the puffer cylinder 18 integrally as a single combination unit 46, as shown in FIG. 3, thus providing the required electrical contact between the conducting cylinder 26 and the puffer cylinder 18 easily and surely.

In accordance with the foregoing, therefore, this invention enables the current carrying capacity of a gas interrupter to be altered, as necessary, without changing the design of other structural components such as the puffer piston, thus also facilitating changes to the current carrying capacity of existing interrupters and removing the need to exchange the entire interrupter. Also, according to this invention, it is easy to meet future changes in current carrying capacity demands, and manufactures can easily provide a series of interrupters of various current carrying capacities.

What is claimed is:

1. A puffer type gas circuit interrupter comprising an insulating housing containing therein an arc extinguishing gas;

a stationary contact assembly disposed within said housing and electrically connectable to an external circuit, and including a stationary arcing contact and a stationary main contact in conductive contact with said stationary arcing contact;

a movable contact assembly disposed within said housing and electrically connectable to an external circuit, said movable contact assembly including a movable arcing contact operable into and out of electrical contact with said stationary arcing contact;

a hollow puffer piston disposed within and secured to said housing, said movable arcing contact slidably extending through said hollow puffer piston;

a puffer cylinder secured to said movable arcing contact and slidable over said puffer piston for defining a puffer chamber therebetween and having an aperture for allowing the arc extinguishing gas to pass therethrough;

an insulating flow guide nozzle secured to said puffer cylinder for directing the arc extinguishing gas compressed within said puffer chamber toward an electric arc established between separated arcing contacts through said aperture in the puffer cylinder upon separation of said arcing contacts;

electrical conductor means rigidly connected to said puffer cylinder with a space disposed therebetween, said electricl conductor means being in conductive contact with said movable arcing contact, said conductor means being movable together with said arcing contact into and out of contact with said stationary main contact, said conductor means separating from said stationary main contact before said arcing contacts separate; and a cluster of stationary finger contacts connectable to the external circuit and disposed around said conductor means for a permanent relative sliding electrical contact thereto.

2. A puffer type gas circuit interrupter as claimed in claim 1, wherein said conductor means comprises a hollow cylindrical member having at its one end an annular flange portion extending substantially radially inward and secured to said puffer cylinder.

3. A puffer type gas circuit interrupter as claimed in claim 2, wherein said flange portion of said conductor means is permanently attached to said puffer cylinder.

4. A puffer type gas circuit interrupter as claimed in claim 2, wherein said flange portion of said conductor means is integral with said puffer cylinder.

5. A puffer type gas circuit interrupter, comprising:

an electrically insulative housing for containing, in use, an arc extinguishing gas;

a stationary electrical contact assembly disposed within said housing and having a portion external of said housing for making electrical connection thereto, said stationary electrical contact assembly comprising a stationary arcing contact and a stationary main contact disposed symmetrically around said stationary arcing contact;

a movable arcing contact within said housing;

a stationary puffer piston within said housing, said stationary puffer piston having an axial bore dimensioned to receive said movable arcing contact and movably mount said movable arcing contact for movement along said axial bore toward and away from said stationary arcing contact, said stationary puffer piston being oriented with said bore aligned toward said stationary arcing contact, and said movable arcing contact being disposed within said bore and mounted by said stationary puffer piston for movement between a position in contact with said stationary arcing contact and positions separated from said stationary arcing contact;

a movable puffer cylinder disposed with said puffer piston in said movable puffer cylinder, said puffer piston being dimensioned to displace any gas within said puffer cylinder as said puffer cylinder moves away from said stationary arcing contact, and said movable puffer cylinder having a gas outlet for venting gas from within said movable puffer cylinder to the region between said fixed and said movable arcing contacts as said movable puffer cylinder moves away from said stationary arcing contact and a gas within said movable puffer cylinder is displaced by said stationary puffer piston;

a movable electrical main contact disposed symmetrically around said movable puffer cylinder and movable therewith, said movable main contact dimensioned to contact said stationary main contact and define therewith an electrically conductive path between said stationary main contact and said movable main contact and between said stationary main contact through said movable puffer cylinder to said puffer piston when said movable and stationary main contacts are in contact with each other; and said movable electrical main contact having a diameter greater than the diameter of said movable puffer cylinder and being spaced from said movable puffer cylinder circumferentially thereof, and said movable electrical main contact having a surface area for electrical conduction at least on the order of the conductive surface area of said movable puffer cylinder for providing a substantially lower electrical resistance through said circuit interrupter when said main contacts are in contact than when only said arcing contacts are in contact.

6. A puffer type gas circuit interrupter according to claim 5, wherein said movable electrical main contact is comprised of a hollow conductive cylinder with an inner diameter greater than the outer diameter of said movable puffer cylinder, said movable main contact is disposed with said movable puffer cylinder therein and axially aligned with said movable puffer cylinder to define an annular space between the inner wall of said movable main contact and the outer wall of said movable puffer cylinder.

7. A puffer type gas circuit interrupter according to claim 6, further comprising means for attaching said movable electrical main contact to said movable puffer cylinder so that said movable main contact moves away from said stationary main contact as said movable puffer cylinder moves away from said stationary arcing contact and in a direction effective to cause displacement of gas from within said movable puffer cylinder by said puffer piston.

* * * * *